US007257896B2

(12) United States Patent
Kurtz

(10) Patent No.: US 7,257,896 B2
(45) Date of Patent: Aug. 21, 2007

(54) TOOL FOR BREAKING SPOT WELDS

(75) Inventor: Scotty R. Kurtz, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/176,016

(22) Filed: Jul. 7, 2005

(65) Prior Publication Data

US 2006/0200998 A1 Sep. 14, 2006

Related U.S. Application Data

(60) Provisional application No. 60/661,145, filed on Mar. 11, 2005.

(51) Int. Cl.
*B26B 3/00* (2006.01)
*B25D 3/00* (2006.01)

(52) U.S. Cl. ..... 30/167; 30/169

(58) Field of Classification Search ..... 30/169, 30/167, 167.1, 167.2, 168; 15/236.01, 245.1, 15/105

See application file for complete search history.

(56) References Cited

U.S. PATENT DOCUMENTS 912,028 A * 2/1909 Prout ..... 30/169
1,569,164 A * 1/1926 Widmer ..... 30/167
1,640,175 A * 8/1927 Barnes ..... 30/169
2,083,123 A * 6/1937 Quick ..... 30/167
2,218,069 A * 10/1940 Mooney ..... 76/119
2,814,870 A * 12/1957 Treiber ..... 30/142
2,910,771 A * 11/1959 Farmer ..... 30/168
3,130,615 A * 4/1964 Harrup, Sr. ..... 81/8.1
4,524,514 A * 6/1985 Mallalieu et al. ..... 30/169
6,076,431 A * 6/2000 Vasudeva ..... 81/44

OTHER PUBLICATIONS

Invention Disclosure Agreement dated Jul. 11, 1996, "Air Chisel Blade for Cutting Spot Welds" Gregory M. Truesdale.
Invention Disclosure Agreement dated Dec. 30, 2002, "Spot Weld Chisel/Door Skin Remover", Dave Budinsky.
Idea Disclosure Agreement dated Dec. 16, 2004, "Spot Weld Popper", Ed Hensley.
Eastwood Unique Automotive Tools and Supplies; Panel Separating Knife; Item #31.38; eastwoodco.com; May 13, 2005.
Integrated Supply Network, Inc. catalog, vol. 4, Issue #3, Mar. 2005, "Seam Buster", Steck Product No. STC20015SB.

* cited by examiner

*Primary Examiner*—Hwei-Siu C. Payer
(74) *Attorney, Agent, or Firm*—Banner & Witcoff, Ltd.

(57) ABSTRACT

A chisel for breaking spot welds of a vehicle includes an elongate handle section with a grip and a slightly angled chisel section with blade faces on three sides and a rib generally parallel to a blade edge to limit insertion of a blade between vehicle body parts.

7 Claims, 2 Drawing Sheets

TOOL FOR BREAKING SPOT WELDS

CROSS REFERENCE TO RELATED APPLICATION

This is a utility application based upon application Ser. No. 60/661,145 filed Mar. 11, 2005 entitled "Tool for Breaking Spot Welds" which is incorporated herewith by reference and for which priority is claimed.

BACKGROUND OF THE INVENTION

In a principal aspect the present invention relates to a tool useful for vehicle repair and, more particularly, vehicle body repair.

Modern vehicles typically include steel sheet metal panels or parts which are spot welded together. When repairing the body or other spot welded components of a vehicle, therefore, it is often necessary to detach the welded components, such as panels, from other parts of the vehicle. It has been suggested that a chisel type tool can be utilized to effect such detachment by removing the welded material at least in part, and subsequently inserting the tool in between the welded parts and breaking of the spot weld by twisting or otherwise manipulating the tool. That is, a small drill bit (as close to the diameter of the spot weld) may be used first to remove as much of the weld as possible. The bit may be allowed to penetrate completely one or both pieces of metal that are welded together. The remaining spot weld may then be separated using the spot weld popper. The present invention relates to an improved chisel type tool designed to function as a device for breaking spot welds so that vehicle body parts may be separated for repair and/or replacement.

SUMMARY OF THE INVENTION

Briefly, the present invention comprises a tool which includes a generally flat, planar, straight metal blade member that is generally rectangular in its plan view configuration and which has a handle member or section, a connected, integral blade end on one side of the handle and an opposite head end on the opposite side of the handle. A chisel blade is formed at the blade end. The chisel blade is comprised of a planar, flat face and an inclined face extending from the planar face to form an angle with the planar face, generally in the range of 18° to 45°. The plane of the chisel blade itself forms an angle with the handle member in the range of about 4° to 12°. The blade end has a generally straight line, forward chisel blade edge transverse to the longitudinal axis of the tool with blade faces and edges on both sides at 90° with respect thereto or, in other words, generally parallel to the longitudinal axis of the tool. Thus, a chisel face is provided on three sides of the blade member. Importantly, the chisel blade further includes a rib spaced from and generally parallel to the forward chisel blade edge. The rib acts to limit insertion of the blade between vehicle body parts thereby promoting the effective use of the tool. The end and side edges of the blade are inclined, but not sharp inasmuch as they have a slightly blunt face. A handle grip or grips are attached to or placed on the blade member, but do not extend over the chisel blade, nor totally to the opposite or head end of the blade member. The tool may be manually held with the head end of the tool positioned for impingement by a hammer or driving tool and the blade end positioned for insertion between body parts and to engage and break a spot weld. The grip is also positioned such that a hammer may impinge the tool in the area above the chisel blade on a lateral side of the tool.

Thus, it is an object of the invention to provide an improved tool for breaking spot welds and in particular, spot welds associated with motor vehicle repair.

It is a further object of the invention to provide a spot weld breaking tool which is easy to use, inexpensive and rugged.

These and other objects, advantages, and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
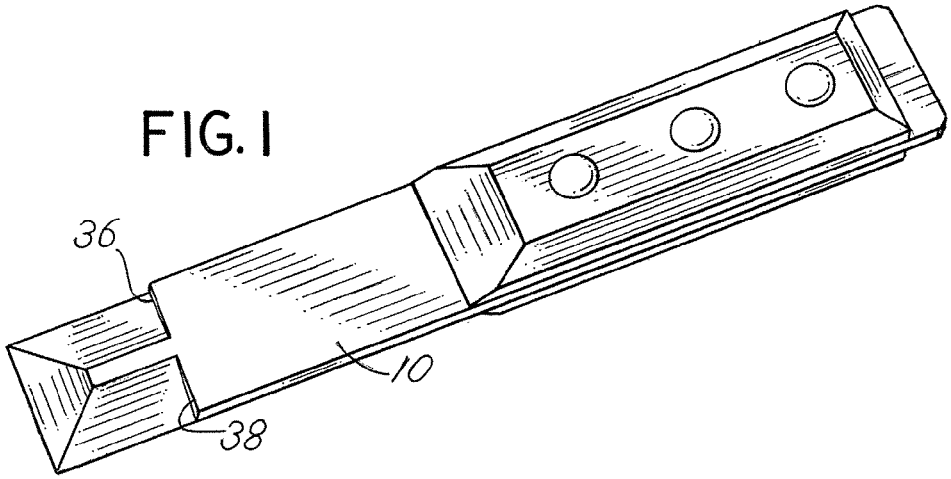
FIG. 1 is an isometric view of a first embodiment of the tool of the invention.

Referring to FIGS. 1-7, a first embodiment of the tool of the invention is comprised of a flat, planar, straight metal blade 10 which, in plan view, has a generally rectangular configuration with a blade end 12 and a head end 14, a longitudinal center line axis 16, a first lateral side 18 and a second, spaced lateral side 20 generally parallel to first lateral side 18. The blade member 10 is comprised of a thin sheet of steel and has a thickness dimension of approximately 0.125 inches. The blade member 10 includes a bottom side 22 and a top side 24 parallel to and spaced from the bottom side.

The blade end 12 is comprised of a first blade edge 26 which is transverse to the center line axis 16, a second lateral side blade edge 28 formed in the lateral side 18 and a third blade edge 30 formed in the lateral side 20. Typically, the length of each blade edge 26, 28 and 30 is approximately 1.25 inches. However, other dimensions may be utilized. The blade end 12 is thus symmetric about the center line axis 16. Each of the blade edges 26, 28 and 30 is comprised of the portion of the blade member 10 forming the bottom surface 22 in combination with an inclined or angled face 27, 29 and 31, respectively. The faces 27, 29 and 31 form an angle in the range of 18° to 45° with the bottom surface or face 22. The preferred angle is approximately 30°. A margin or end face 36 is provided with respect to and normal to the blade face 29 and a second margin face or end face 38 is provided with respect to and normal to the blade face 31. These faces 36 and 38 are more apparent in FIG. 1 and are transverse to axis 16. Faces 36 and 38 tend to limit the extent to which the tool may be driven into a space between spot welded panels and also serve to provide a purchase surface which facilitates twisting of the tool to disengage and break a spot weld, for example.

Figure 2:
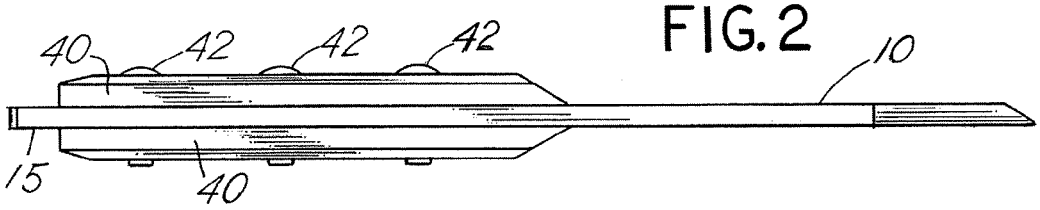
FIG. 2 is a side elevation of the tool of FIG. 1.
Figure 3:
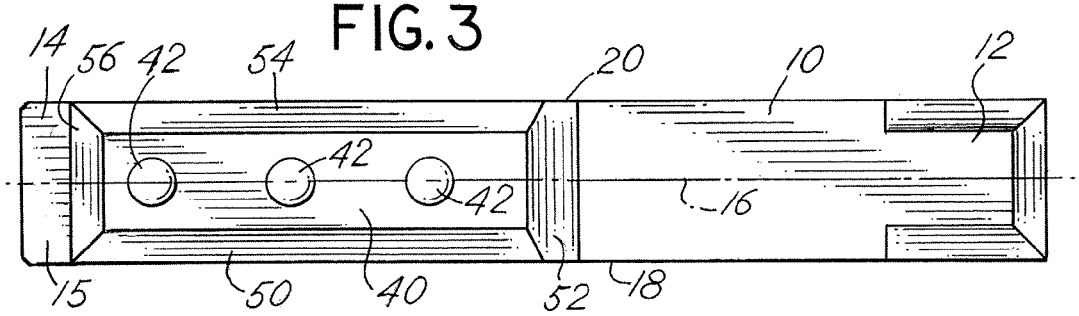
FIG. 3 is a top plan view of the tool of FIG. 1.
Figure 4:
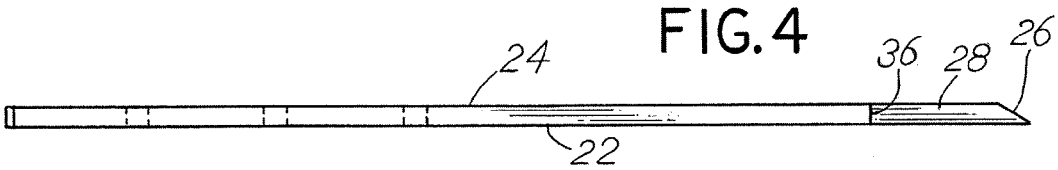
FIG. 4 is a side view of the flat, planar, straight metal blade member element of the tool of the invention.
Figure 5:
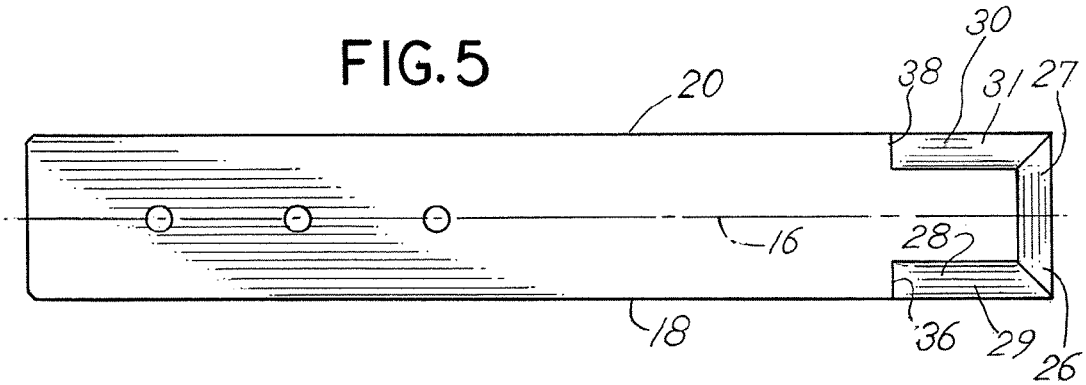
FIG. 5 is a top plan view of the tool element of FIG. 4.
Figure 6:
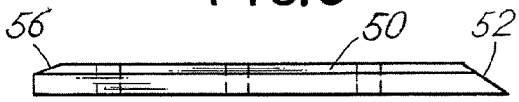
FIG. 6 is a side elevation of the handle grip member used in combination with the tool blade of FIGS. 4 and 5 to construct the tool of FIGS. 1-3.
Figure 7:
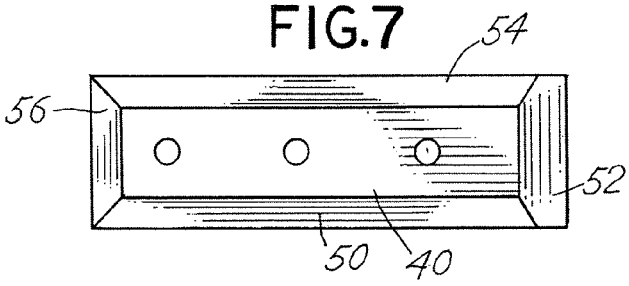
FIG. 7 is a top plan view of the handle grip member of FIG. 6.

FIGS. 6 and 7 illustrate the handle members. Handle members of a substantially identical construction are attached to the opposite sides 22 and 24 of the blade member 10. The handle member 40 in FIGS. 6 and 7 is designed to fit within the profile of the blade member 10. The handle members 40 are attached to the opposite sides of blade member 10 by means of rivets 42 as depicted in FIG. 2. The handle members 40 are attached adjacent the head end 14 of the blade member 10. However, the head end 14 of the blade member 10 includes a section, 15 in FIG. 3, over which the handle members 40 do not fit or extend. This provides a clearance between the handle members 40 and the head end 14 to enable impacting on the head end 14 without engaging the handle members 40.

To use the tool of the invention, the tool is wedged or driven between spot welded panels, for example, by impacting the head end or a side of the tool. The tool may then be further impacted on the head end 14 or on one of the lateral sides 18 or 20 to drive the blade portion or edge 26, 28, 30 against a spot weld and thereby break or open the weld. By maintaining the handle members or grips 40 within the profile of the blade member 10, the tool may be impacted by a driving mechanism such as a hammer along substantially any side without adversely impacting on the grip members or handle members 40. To enhance the comfort of the handle members 40, the members each include shaped peripheral surfaces such as the surfaces 50, 52, 54 and 56.

Figure 8:
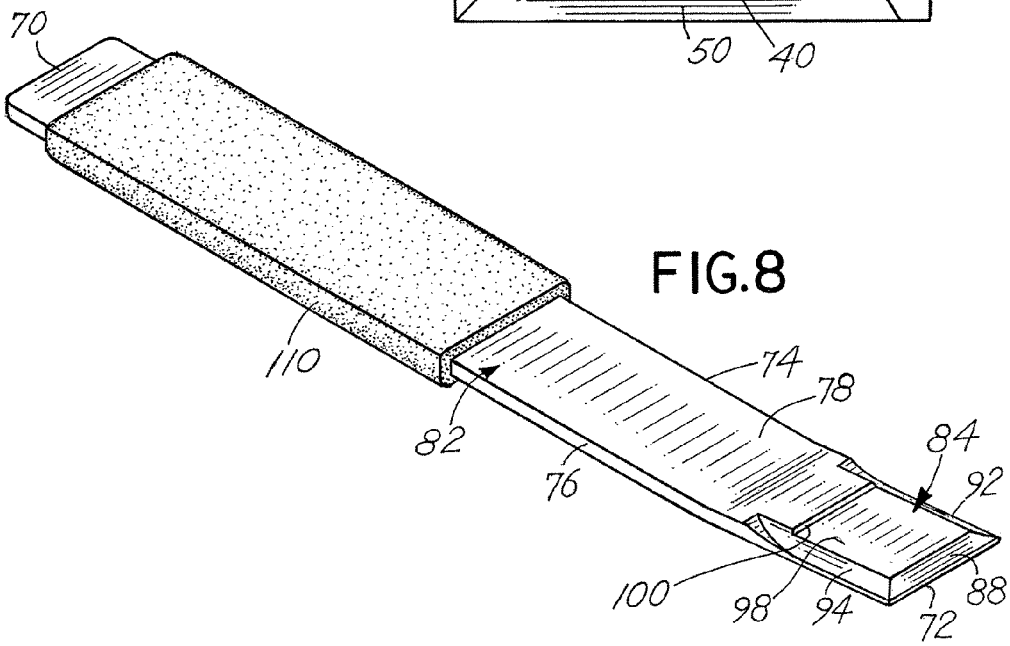
FIG. 8 is an isometric view of a preferred alternative embodiment of the invention.
Figure 9:
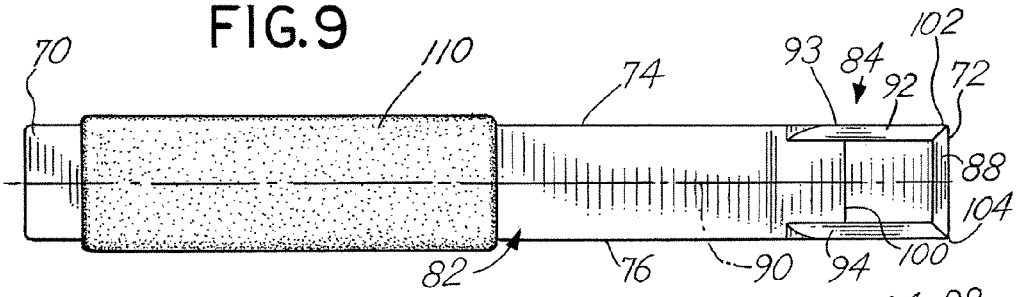
FIG. 9 is a top plan view of the tool of FIG. 8.
Figure 10:
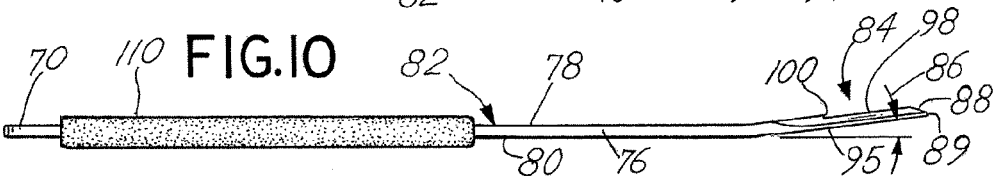
FIG. 10 is a side elevation of the tool of FIG. 8.

FIGS. 8, 9 and 10 depict a second preferred embodiment of the invention. The tool as depicted in FIGS. 8, 9, and 10 is formed from a generally rectangular parallelepiped strip of steel which is machined and configured as described hereinafter. Thus, a chisel tool is depicted in these figures and includes a head end 70, an opposite blade edge 72, a first lateral side 74, a second generally parallel lateral side 76, a top face 78 and a bottom face 80. The blade or tool is divided generally into two sections. The first section is a handle section 82 and the second section is a chisel blade generally at 84. The chisel blade 84 is uniquely formed or constructed. That is, the chisel blade 84 forms an angle 86 with the lower face 80 in the range of 4°-12° and preferably in the range of 5°-7°±1°. The chisel blade 84 includes three blade faces; namely, an end blade face 88 which is arranged at a right angle or transverse to a longitudinal axis 90 of the blade. Further included is a lateral or side blade face 92 and a second lateral or side blade face 94 joined to and connected to the end face 88 and at right angles thereto. The lateral side faces 92 and 94 are generally parallel to each other. The faces 88, 92 and 94 typically all include the same angle of inclination between the face 88, 92 and 94 and the bottom face 80. That angle is typically in the range of 18° to 45° and preferably in the range of about 22°±1°. As a consequence, the extreme ends and sides of the chisel blade 84; namely, the end 89, side 93 and opposite side 95 are blunt and in a preferred embodiment have a dimension in the range of about 0.020-0.025 inches. Typically, the chisel blade 84 itself has a longitudinal dimension in the range of about 2 inches and the handle section or handle member 82 is in the range of about 6-8 inches in the longitudinal direction. Typically, the width of the chisel tool is in the range of 1-2 inches, preferably about 1.75 inches. Top face 78 is parallel to bottom face 80 and about 0.100±0.005 inches therefrom. This is the dimension transverse to the longitudinal axis 90. Blunt edges 89, 93, 95 are preferably in the range of about 0.020-0.025 inches in height. Importantly, the chisel blade 84 has a top face section 98 which is cut away so that a transverse rib 100 is defined. The rib 100 is typically in the range of about 1.00 to 1.13 inches from the extreme transverse blunt edge 89.

The intersecting edges of the inclined faces 88 and 92, as well as the intersection of the faces 88 and 94, are slightly rounded, preferably with a radius of about 0.06 inches. These rounded edges 102 and 104 are provided so that when the tool is used to insert between vehicle body parts, the intersecting edges will not catch or tend to gouge the welded parts.

A hand grip covering 110 is incorporated on the handle portion or section 82. Hand grip may be formed from a rubber or polymer material. The head end 70 remains uncovered to enable tapping or driving from head end 70. The hand grip 110 may encircle the hand section 82 or may have the construction of the first embodiment.

As a result of the described construction of FIG. 10, it will be noted that the thickness of the chisel blade 84 is diminished somewhat to enhance the ability to insert the tool between spot welded vehicle body parts. Additionally, the rib or edge 100 provides a "feel" enabling a worker to properly limit the insertion of the tool between spot welded vehicle body parts. The edge 100 thus serves as a reference element for use of the tool. Inclining the chisel blade 84 relative to the handle section 82 enables use of a hammer or other tool to facilitate insertion of the chisel blade between vehicle body parts to effect breaking of a spot weld.

It is possible to vary the configuration of the tool of the invention without departing from the spirit and scope thereof. The invention is therefore limited only by the following claims and equivalents thereof.

What is claimed is:

1. A tool for breaking a spot weld joint comprising, a metal member having a handle section and a chisel blade, said handle section terminated at a head end, and said chisel blade terminated at a blade end;

said member including first and second spaced, generally parallel lateral sides joining the head end and the blade end, a generally flat top face, and a parallel, generally flat bottom face, said chisel blade comprising the top face, the bottom face, a first inclined, planar end face extending from the top face toward the bottom face to form a first acute angle with the bottom face in the range of about 18° to 45° therewith, and a first side blade face and a second side blade face extending from the top face respectively to the first and second spaced, lateral sides and at an acute angle substantially equal to the first acute angle;

a handle grip on the handle section, said chisel blade forming an included angle with said handle section in the range of about 4° to 12°, said chisel blade further including a cut away section into the top face defining a rib, said rib generally parallel to the blade end.

2. The tool of claim 1 wherein the handle grip is intermediate the head end and the chisel blade.

3. The tool of claim 1 wherein the first acute angle is about 22°±1°.

4. The tool of claim 3 wherein the included angle of the chisel blade and the handle section is about 5° to 7°±1°.

5. The tool of claim 1 wherein the included angle of the chisel blade and the handle section is about 5° to 7°±1°.

6. The tool of claim 1 wherein the transverse width of the chisel blade is about 1.75 inches.

7. The tool of claim 1 wherein the dimension between the top face and the bottom face is about 0.100 to ±0.005 inches in thickness.

* * * * *